United States Patent [19]

Matsuda et al.

[11] Patent Number: 4,880,476

[45] Date of Patent: Nov. 14, 1989

[54] PROCESS FOR THE PHOSPHATE CHEMICAL CONVERSION TREATMENT OF A STEEL MATERIAL

[75] Inventors: Shigeki Matsuda, Okazaki; Kazuhiko Mori, Hiratsuka; Wataru Gotou, Kariya; Takahiro Ohnuki, Nagoya, all of Japan

[73] Assignees: Nippondenso Co., Ltd.; Nihon Parkerizing Co., Ltd., both of Tokyo, Japan

[21] Appl. No.: 130,495

[22] Filed: Dec. 9, 1987

[30] Foreign Application Priority Data

Dec. 9, 1986 [JP] Japan ..... 61-291574
Nov. 30, 1987 [JP] Japan ..... 62-300150

[51] Int. Cl.[4] ..... C23C 22/12
[52] U.S. Cl. ..... 148/253; 148/262
[58] Field of Search ..... 148/6.15 R, 6.15 Z

[56] References Cited

U.S. PATENT DOCUMENTS 3,082,128 3/1963 Craig ..... 148/6.15 Z
3,116,178 12/1963 Upham ..... 148/6.15 Z
3,723,192 3/1973 Oei ..... 148/6.15 Z
3,819,385 6/1974 Scheimicher ..... 148/6.15 Z
4,086,103 4/1978 Woods ..... 148/6.15 Z
4,110,127 8/1978 Longuepee ..... 148/6.15 Z
4,416,705 11/1983 Siemund ..... 148/6.15 Z
4,490,185 12/1984 Gottwald ..... 148/6.15 Z
4,497,668 2/1985 Mady ..... 148/6.15 Z

*Primary Examiner*—Sam Silverberg
*Attorney, Agent, or Firm*—Cushman, Darby & Cushman

[57] ABSTRACT

A corrosion-resistant phosphate chemical conversion coating layer is formed on a steel material surface by a process comprising bringing the steel material into contact with a treatment liquid containing mixed anions consisting of phosphate ions and at least one other type of active anions, at least one type of metal ions, and an oxidizing agent, to provide a phosphate chemical conversion coating layer on the surface of the steel material, wherein the ratio (P/An) in weight of the phosphate ions (P) to the total of mixed anions (An) is ½ or less and the temperature of the treatment liquid is maintained at a level of 40° C. or less without external heating.

13 Claims, 4 Drawing Sheets

(X 1000)

(X 1000)

PROCESS FOR THE PHOSPHATE CHEMICAL CONVERSION TREATMENT OF A STEEL MATERIAL

BACKGROUND OF THE INVENTION

1. Field of the Invention

The present invention relates to a process for a phosphate chemical conversion treatment of a steel material which may be a surface-treated steel sheet, for example, a zinc-plated steel sheet. More particularly, the present invention relate to a process for the phosphate chemical conversion treatment of a steel material by using a specific phosphate chemical conversion treating liquid at room temperature to form a phosphate coating layer firmly fixed on the steel material.

2. Description of the Related Arts

With aspect to treatment temperature, phosphate chemical conversion treatment baths are classified into a room (ambient atmospheric) temperature treatment bath and a high temperature treatment bath. The high temperature treatment bath is usually used while heating the bath at a temperature of more than 40° C., and the conventional phosphate chemical conversion treatment bath used for pretreating parts of cars prior to painting is usually a high temperature treatment bath. The room temperature treatment bath is usually used at a temperature of 40° C. or less, preferably 35° C. or less but 0° C. or more, without external heating.

U.S. Pat. No. 4,233,087 discloses a process for the room temperature chemical conversion treatment. In this process, wherein an acid phosphate chemical conversion treatment bath containing hydrogen peroxide as an oxidizing agent is used, a molar ratio ($PO_4/Zn$) of phosphate ions to metal (zinc) ions is maintained in a range of from 0.5 to 3.7, and the phosphate chemical conversion treatment is smoothly carried out so that even if an additional feed is introduced into the bath, the chemical conversion treatment can be stably effected at room temperature. To enable the molar ratio ($PO_4/Zn$) to be maintained at the predetermined level, a certain amount of $N^{n-}$ ions, which are a diluting agent for the anions and are selected from $NO_3^-$, $SO_4^{2-}$ and $Cl^-$ ions, must be kept in the treating bath. In the process of the above-mentioned U.S. patent, preferably, the pH of the bath is at a level of about 3.0 and the ratio in weight of the phosphate ions to the entire mixed anions in the conversion treating bath is 70% or more.

U.S. Pat. No. 4,565,585, an inventor of which is one of the inventors of the present invention, relates to a phosphate chemical conversion treatment process at room temperature. This process is characterized in that the phosphate chemical conversion treatment is carried out at a specific level of pH and oxidation-reduction (redox) potential (ORP) so that a general electrochemical corrosion reaction can occur on an entire surface of the steel material, and thus a phosphate chemical conversion coating layer can be formed on the steel material surface. In an example of U.S. Pat. No. 4,565,585, the ratio of the weight of phosphate ions to the entire weight of the mixed anions in the chemical conversion treating liquid is in the range of from 70% to 80%.

U.S. Pat. No. 4,657,600 discloses a process of phosphate chemical conversion treatment for a steel material with a treating liquid containing metal ions, oxacid ions, and phosphate ions, and having a pH and an oxidation-reduction potential (ORP) adjusted to a predetermined level, respectively, without directly replenishing nitrite ions as an oxidizing agent. The principal chemicals comprise the above-mentioned ions. In this process, the oxidizing agent such as nitrite ions must not be directly added to the principal chemicals. When this type of oxidizing agent is mixed with principal chemicals of the chemical conversion treatment before they are fed into the chemical conversion treating liquid, the principal chemicals react with the oxidizing agent to a large extent, and therefore, the oxidizing agent must be added to the chemical conversion treatment liquid separately from the principal chemicals, namely, the phosphate ions, metal ions, oxacid ions, etc.

As disclosed in U.S. Pat. No. 4,565,585, the phosphate chemical conversion coating layer-forming reaction at room temperature comprises an electrochemical anodic reaction which causes iron to be dissolved, and a chemical conversion coating layer-forming reaction for producing iron phosphate and zinc phosphate. That is, in the first step of the phosphate chemical conversion coating layer-forming reaction, a portion of iron located in the surface portion of the steel material is dissolved in accordance with the conversion: $Fe \rightarrow Fe^{2+} + 2e$, and after the portion of iron is dissolved to form iron ions, reactions of phosphate ions with iron ions and zinc ions occur on the surface of the steel material.

When considered from a thermodynamic point of view, the above-mentioned chemical reactions progress in a direction in which the Gibbs free energy ($\Delta G$) of the whole reaction system is decreased. This $\Delta G$ is defined by the following equation (1):

$$\Delta G = \Delta H - T\Delta S \quad (1)$$

wherein $\Delta H$ represents an enthalpy of the reaction system, T represents an absolute temperature of the reaction system, and $\Delta S$ represents an entropy of the reaction system.

The equation indicates that a decrease of the $\Delta G$ of the reaction system is realized by decreasing the $\Delta H$ of the reactions or by increasing the $\Delta S$. When an external energy is imparted, i.e., heating, the $\Delta H$ of the reaction system increases, and thus the reaction progresses in a direction of increasing the $\Delta S$. That is, in a high temperature treating liquid, the $\Delta S$ increasing reaction is carried out in accordance with reaction (2):

$$H^+ + e \rightarrow \tfrac{1}{2}H_2 \quad (2)$$

As a result of the reaction (2), the concentration of $H^+$ ions in the high temperature treating liquid decreases, and thus dissociation of the phosphoric acid is promoted. However, in the room temperature treating liquid, reaction (2) is difficult to obtain.

In U.S. Pat. No. 4,565,585 the inventor of the present invention made it clear that an important difference between the room temperature and high temperature phosphate chemical conversion treatments resides in the reactivity of reaction (2), and disclosed a specific method for practically utilizing the specific reactions in the room temperature phosphate chemical conversion treatment liquid.

The inventors of the present invention studied the conventional room temperature phosphate chemical conversion treatment process from the view point of an etching of the steel material to be treated.

In comparison with a high temperature treatment liquid which is heated, the phosphate ions in the room temperature treatment liquid, which is not heated, are in a non-activated state. Phosphoric acid has a relatively low degree of dissociation, and thus is included in a weak acid group having a low activity.

Generally, phosphate ions, other types of anions, and cations have a higher activity in a high temperature treatment liquid than that in a room temperature treatment liquid. Also, generally, when a content of phosphate ions based on the weight of the total of mixed anions is high, the resultant phosphate chemical conversion treatment liquid exhibits high stability compared to a room temperature treatment liquid having a low content of phosphate ions. However, the stable treatment liquid exhibits a low chemical activity, and thus is not adequate for etching a steel material.

Here it is important to note that the phosphate chemical conversion reaction in any of the room temperature and high temperature treatment liquids of any type of phosphate chemical conversion treatment compositions can be understood as being a phosphate chemical conversion coating layer-forming reaction derived from a dissolution of iron from the steel material. The research of Maclu, as disclosed in The Journal of the Metal Finishing Society of Japan, Vol. 20, No. 5, pages 39 to 42, 1969 and evaluated as a most authoritative study on the phosphate coating layer-forming reactions, analyzed in detail the reaction in the conventional high temperature treatment liquid. In this analysis, the phosphate coating layer-forming reaction was illustrated as a reaction derived from the dissolution of iron in the steel material. In the conventional high temperature treatment liquid, generally, the weight ratio of the phosphate ions to the total of the mixed anions is relatively high, but since the total amounts of ions in the treatment liquid at an elevated temperature are active, the dissolution of iron from the steel material is promoted.

In a conventional room temperature phosphate chemical conversion treatment liquid disclosed in U.S. Pat. No. 4,565,585, which contains phosphate ions in a weight ratio of more than 50% to the total of mixed anions, where the steel material is very weakly etched, there is a disadvantage in that, even if a phosphate chemical conversion coating layer is formed on the steel material, the adhesion of the coating layer to the steel material is not strong. To enhance the etching effect on the steel material, if the concentration of phosphate ions is excessive compared with that in the conventional treatment liquid, the resultant treatment liquid exhibits an excessively low pH and has and unbalanced composition, and thus cannot form an effective phosphate chemical conversion coating layer on the steel material. The above-mentioned disadvantages appear particularly when the treatment is carried out by immersion. Where the treatment is carried out by spraying, the steel material always comes into contact with a fresh treatment liquid, the reaction of the steel material with the treatment liquid is in a gas phase, and thus the etching of the steel material is properly effected.

As described in U.S. Pat. No. 4,565,585, when a room temperature treatment liquid containing an excessively large amount of phosphate ions is applied by spraying, the etching effect of the room temperature treatment liquid is smaller than that of the high temperature treatment liquid. However, in the spraying, since the steel material can always come into contact with a fresh active treatment liquid in a gas phase, the treatment liquid can properly react with the steel material and easily form a phosphate chemical conversion coating layer firmly fixed on the steel material.

In the immersion method, the steel material cannot always come into contact with a fresh treatment liquid, and all the reactions are carried out in a liquid phase. Accordingly, when a conventional room temperature treatment is carried out by immersion, an extra method is needed to obtain a firmly fixed phosphate chemical conversion coating layer. Usually, when the conventional treatment is carried out by immersion, using a phosphate chemical conversion treatment liquid containing an excessively large amount of phosphate ions, it is difficult to etch the steel material to a satisfactory extent and to form a phosphate chemical conversion coating layer firmly fixed on the steel material.

In a practical room temperature phosphate chemical conversion treatment, it is important to satisfy the following requirements:

(A) The treatment can be carried out in a continuous manner.

(B) The conditions of the treatment liquid for the phosphate chemical conversion can be continuously controlled.

(C) To realize the above requirements (A) and (B), an undesirable generation of sludge in the treatment liquid is prevented or restricted.

However, a room temperature phosphate chemical conversion treatment process by immersion which fully satisfies the above mentioned requirements has not been found.

SUMMARY OF THE INVENTION

An object of the present invention is to provide a process for the phosphate chemical conversion treatment of a steel material at room temperature, in which process the steel material can be etched to a satisfactory extent.

Another object of the present invention is to provide a process for the phosphate chemical conversion treatment of a steel material, capable of producing a phosphate chemical conversion coating layer firmly fixed on the steel material, at room temperature.

The above-mentioned objects can be attained by the process of the present invention, which comprises bringing a steel material into contact with a phosphate chemical conversion treatment liquid containing mixed anions consisting of phosphate ions and at least one other type of active anions, at least one type of metal ions capable of forming a chemical conversion coating layer, and an oxidizing agent, to provide a phosphate chemical conversion coating layer on the surfaces of the steel material, wherein the ratio (P/An) of the weight (P) of the phosphate ion to the entire weight (An) of the mixed anions is $\frac{1}{2}$ or less and the temperature of the phosphate chemical conversion treatment liquid is controlled to a level of 40° C. or less without external heating of the liquid.

DESCRIPTION OF THE PREFERRED EMBODIMENTS

Figure 1:
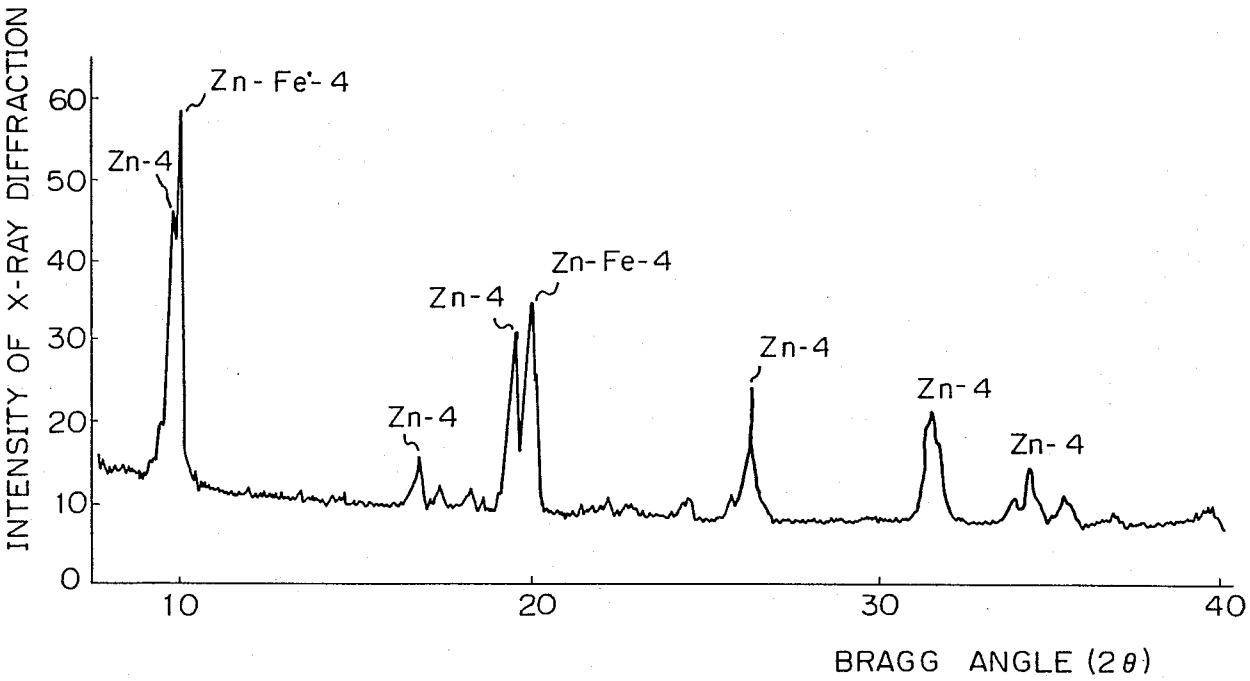
FIG. 1 shows an X-ray diffractiometric pattern of an embodiment (Example 1) of the phosphate chemical conversion coating layer formed on a steel sheet in accordance with the process of the present invention.

In the process of the present invention, the phosphate chemical conversion treatment liquid comprises mixed anions consisting of phosphate ions and at least one type of other active anions, metal ions, for example, zinc ions, and an oxidizing agent, which are used in conventional room temperature and high temperature conversion treatments, and the temperature of the treatment liquid is controlled to a level of 40° C. or less without external heating of the liquid. The process of the present invention is characterized in that the ratio (P/An) of the weight (P) of the phosphate ions to the total weight (An) of the mixed anions is controlled to a level of ½ or less. Namely, the weight ratio of the other types of active anions to the total of mixed anions is adjusted to a level of ½ or more.

The specific composition of the treatment liquid of the present invention effectively promotes the etching effect of the treatment liquid for the steel material.

In the process of the present invention, the other types of active anions different from phosphate ions include anions having at least one non-metallic element atom, for example, acid ions such as oxacid ions and halogen ions. The other types of active anions have a larger dissociation coefficient than that of phosphate ions.

The typical other types of anions usable for the process of the present invention are $NO_3^-$, $ClO_3^-$, $SO_4^-$, and $Cl^-$, but preferable other anions $NO_3^-$ which are used in conventional processes and have an oxidizing activity. The $ClO_3$ ions are more active o unstable than the $NO_3^-$ ions and, therefore, are preferably used together with $NO_3^-$ ions. However, in the process of the present invention, the other type of active anions do not include anions to be used as an oxidizing agent.

The term "oxidizing agent" is used herein in the usual way in which it is used in the phosphate chemical conversion treatment process, and includes oxidation-active chemicals, for example, hydrogen peroxide, hydrogen peroxide-generating substances, and other oxidation-active substances such as nitrite ions, which exhibit a high rate of reaction with principal chemicals, for example, phosphate ions and metal ions, when mixed with the treatment liquid, and thus can not be directly mixed with the principal chemicals. This type of oxidizing agent is very active in the dissociated state and, therefore, is added in a very small amount to the treatment liquid. Accordingly, in the process of the present invention, the mixed anions in the phosphate chemical conversion treatment liquid are defined as those not containing anions derived from the oxidizing agent. Namely, in the calculation of the weight ratio P/An, the total weight An of the mixed anions does not include the weight of the anions derived from the oxidizing agent. An increase in the concentration of the other types of active anions is more effective for increasing the solubility of the metal cations, for example zinc ions, than an increase in the concentration of the phosphate ions, and the increased amount of other types of anions exhibits an increased reactivity to the steel material, and effectively enhances the etching activity of the treatment liquid to the steel material.

The other types of active anions have high solubility in the phosphate chemical conversion treatment liquid and, therefore, make the deposition of the coating-forming component, for example, zinc phosphate, in the phosphate chemical conversion treatment liquid difficult. Accordingly, the chemical conversion treatment liquid per se is very stable as long as no chemical conversion reactions occur in the liquid.

As a characteristic feature of the process of the present invention, the weight ratio P/An of the phosphate ions to the total of mixed anions in the phosphate chemical conversion treatment liquid is 0.5 (½) or less. Where the treatment is carried out by a continuous immersion, the ratio P/An is preferably in a range of from 0.04 to 0.4.

When the ratio P/An is more than 0.5, the influence of the phosphate ions on the treatment process becomes excessive, and the activity of the treating liquid is decreased. When the ratio P/An is too small, for example, less than 0.08, the amount of the phosphate ions becomes insufficient and the formation of the phosphate chemical conversion coating layer becomes difficult.

Especially, when a treatment liquid containing the phosphate ions in a weight ratio P/An of more than 0.4 to the entire mixed anions is used for a continuous chemical conversion treatment, control of the concentrations of the treatment liquid sometimes becomes difficult. This is illustrated by Referential Example 1. Also, when the weight ratio P/An is less than 0.08, the formation of the chemical conversion coating layer sometimes becomes difficult.

If halogen ions, which are usable as one other type of active anions, are used, fluorine ions should be present in a very small amount. That is, the fluorine ions should be distinguished in the amount to be used from other halogen ions, for example, chlorine ions.

In the formation of the phosphate chemical conversion coating layer, not only the dissolution of iron from the steel material but also the deposition of a metal phosphate, for example, zinc phosphate, on the surface of the steel material, is important.

In the phosphate chemical conversion treatment liquid for the process of the present invention, the weight ratio of the phosphate ions to the total of mixed active anions in the liquid is relatively small, and thus the weight ratio of the metal ions, for example, zinc ions, to the phosphate ions is relatively large. As a result, the metal ions are in an adequate condition for easily depositing the metal ions as a metal phosphate; in the other words, for easily forming a phosphate chemical conversion coating layer on the steel material surface.

Namely, the conditions of the phosphate chemical conversion treatment liquid of the present invention are adequate not only for accelerating the dissolution of iron from the steel material surface but also for promoting the deposition of the metal phosphate on the steel material surface.

Accordingly, in the process of the present invention, it is very important to adjust the weight ratio of the phosphate ions to the total of mixed active anions in the phosphate chemical conversion treatment liquid, to a level of 0.5 or less.

Of course, the phosphate chemical conversion reaction per se is carried out as an electrochemical reaction, and thus the process of the present invention follows, in principle, the concept of the invention of U.S. Pat. No. 4,565,585. However, the above-mentioned specific feature of the present invention enables the treatment liquid for the process of the present invention to be applied at wide ranges of pH and ORP, respectively. That is, in the process of the present invention, a phosphate chemical conversion coating layer can be formed at a pH of from 0.5 to 4.5, preferably from 2.0 to 4.0 and at an ORP (hydrogen standard electrode potential) of 300 mV or more.

The metals for forming the chemical conversion coating layer in the process of the present invention can be selected from usual phosphate chemical conversion coating layer-forming metals, for example, Zn, Ca, Mg, Mn, and Fe. Usually, the concentration of the metals in the treatment liquid should be maintained at a certain level, for example, 0.3 g/l or more. The treatment liquid may contain at least one type of heavy metal ions, for example, Ni, Ti, Pb, Sn, and Cr, in addition to the above-mentioned metals so that the heavy metal is contained in a certain amount in the resultant phosphate chemical conversion coating layer. The additional heavy metals serve as an additive for electrolytic deposition in the same manner as in electroplating. Also, the treatment liquid may contain, as an additive, a small amount of a water-soluble organic substance and inorganic filler which are usually used for electroplating, etc., so that the additive is contained in the resultant chemical conversion coating layer.

The substrate to be subjected to the process of the present invention is a steel material. The steel material includes surface-treated steel sheets, for example, a steel sheet electroplated with zinc, in addition to ordinary steel materials.

The preferable control conditions for the process for the phosphate chemical conversion treatment of a steel material will be explained in detail below.

As disclosed in detail in U.S. Pat. No. 4,565,585, the reactions occur electrochemically in the phosphate chemical conversion treatment liquid at room temperature. The electrochemical reactions can be controlled by controlling the pH and the ORP of the treatment liquid under conditions such that ions of substances contributing to the reactions are in predetermined ranges of concentrations.

In the phosphate chemical conversion treatment liquid for the process of the present invention, preferably the pH is controlled to the level of 0.5 to 4.5, more preferably 2.0 to 4.0 and the ORP (hydrogen standard electrode potential) to a level of 300 mV or more. When the pH is less than 0.5, the concentration of $H^+$ (hydrogen ions) in the treatment liquid can become extremely large, and the reactions for the formation of phosphate chemical conversion coating layer are hindered. When the pH is more than 4.5, the concentration of hydrogen ions in the treatment liquid can become extremely small, and thus, the activity and usefulness of the treating liquid become insufficient. Since the content of the phosphate ions, which are ions of a weak acid having a low degree of dissociation, in the treatment liquid for the process of the present invention is relatively small, often, in a composition of the treatment liquid in which the liquid exhibits a high pH, the etching effect of the treatment on the steel material surface is reduced.

The ORP of the treatment liquid is variable in response to the effective concentration of the oxidizing agent in the treatment liquid. When the ORP is less than 300 mV, the oxidizing agent may not work efficiently, and thus the formation of the phosphate chemical conversion coating layer becomes insufficient.

Also, the ORP in the treatment liquid is variable depending on the value of the pH. When the concentration of the oxidizing agent in the treatment liquid is maintained at a constant level, a decrease in pH results in an increase in ORP, because the reactions of the oxidizing agent are followed by a movement of $H^+$ (hydrogen ions), and thus the lower the pH, the higher the chemical activity of the treatment liquid and, therefore, the higher the ORP.

Accordingly, preferably, in the phosphate chemical conversion treatment liquid, the pH is controlled to a level of 0.5 to 4.5 and the ORP is controlled to a level of 300 mV or more. Also, preferably, when the pH is relatively low, the ORP is controlled to a relatively high level.

The above-mentioned range of pH of from 0.5 to 4.5 includes a range of from 0.5 to 3.2. Before the present invention it was believed that, when a conventional room temperature phosphate chemical conversion treatment liquid containing an excessive amount of phosphate ions was used at a pH of 3.2 or less, the formation of a practical phosphate chemical conversion coating layer was difficult. That is, it was believed that when the conventional treatment liquid containing an excessive amount of phosphate ions was used at a pH of 3.2 or more at room temperature by an immersion treatment, the conventional treatment liquid exhibited a low chemical activity but an enhanced etching property, and thus the formation of the phosphate chemical conversion coating layer was insufficiently effected. Accordingly, the conventional composition of the phosphate chemical conversion treatment liquid was believed to be not satisfactory in the formation of the coating layer. In the composition of the phosphate chemical conversion treatment liquid of the present invention, since the composition is controlled so that the etching can be effected by other types of active anions different from the phosphate ions, the concentration of the metal ions, for example, zinc ions, in the treatment liquid can be adjusted to a high level compared with that of the phosphate ions, and thus the resultant zinc phosphate exhibits an enhanced capability for an easy deposition when forming a phosphate chemical conversion coating layer on the steel material surface. Accordingly, even at a pH of 3.2 or less, at which the formation of the coating layer was believed to be difficult before the present invention, the phosphate chemical conversion coating layer can be electrochemically formed on a steel material surface by using the specific phosphate chemical conversion treatment liquid in accordance with the process of the present invention.

In consideration of the formation of the coating layer, the weight ratio (P/M) of the phosphate ions (P) to the phosphate chemical conversion coating layer-forming metal ions (M) in the treatment liquid is preferably in the range of from 0.3 to 3. When the ratio (P/M) is less than 0.3, the resultant metal phosphate deposit is sometimes formed in the treatment liquid but not on the surface of the steel material. When the ratio (P/M) is more than 3, the concentration of the phosphate ions sometimes becomes excessively large and the deposition of metal phosphate becomes very difficult not only in the treatment liquid but also on the surface of the steel material. In other words, a ratio (P/M) of more than 3 causes a need for an increased energy for the deposition of metal phosphate, and this is not preferable for the process of the present invention.

In the process of the present invention, the composition of the phosphate chemical conversion treatment liquid can be controlled as follows.

When the process of the present invention is carried out by a continuous immersion, it is important that the following conditions are attained.

(1) The ratio (P/An) is maintained in the range of from 0.08 to 0.4.

(2) The concentrations of the components are maintained at predetermined levels.

As described in U.S. Pat. No. 4,565,585, the phosphate chemical conversion treatment reaction system at room temperature can be deemed an electrochemical reaction system. Also, as stated in the U.S. Pat. No. '585, the electrochemical reaction system can be controlled by controlling electrochemical parameters such as the pH and ORP of the treatment liquid. Accordingly, the phosphate chemical conversion treatment reaction system used for the process of the present invention can be controlled at room temperature under a condition in which the temperature does not vary, in accordance with the above-mentioned principle.

The electrochemical parameters to be controlled are the electroconductivity, pH, and ORP of the treatment liquid. In the process of the present invention, the pH and ORP can be controlled in the same manner as disclosed in U.S. Pat. No. 4,565,585.

To realize the above-mentioned control, a concentrated liquid containing at least the principal effective components, except for the oxidizing agent, in substantially the same proportions as those of the treatment liquid, and having a pH of 2.5 or less and a relatively high degree of acidity, is used.

In the treatment liquid of the present invention, the ORP is controlled to a predetermined upper limit or less by adding the above-mentioned concentrated liquid containing $Fe^{2+}$, the electroconductivity (EC) is controlled to a predetermined level or more by adding the above-mentioned concentrated -, NO -, etc. When the EC liquid containing $Zn^{2+}$, $H_2PO_4^-$, $NO_3^-$, etc. When the EC of the treatment liquid exceeds a predetermined upper limit, even though the pH of the treatment liquid exceeds a predetermined upper limit, the principal component chemicals should not be added to the treatment liquid.

The phosphate chemical conversion treatment reactions can be controlled to a constant condition by controlling the above-mentioned parameters, pH, ORP, and EC, in the above-mentioned manner, so as to maintain the electrochemical conditions at constant levels. As a result, the concentrations of the components and the weight ratio P/An can be maintained at predetermined levels. Generally, the phosphate chemical conversion reactions at room temperature or a high temperature comprise the two steps of dissolving a surface portion of the steel and forming a chemical conversion coating layer. In the dissolving step for the steel material, it is important to evenly dissolve the surface position of the steel material at a proper dissolving rate and in a proper amount. When the steel material surface portion is unevenly dissolved at an uneven dissolving rate and in an uneven distribution, some portions of the steel material surface are coated and other portions are not coated, and the resultant coating layer is unevenly distributed on the steel material surface.

That is, the dissolving reaction rate and the coating layer-forming reaction rate must be well-balanced to form an even coating layer.

When a conventional phosphate chemical conversion treatment liquid having a weight ratio (P/An) of the phosphate ions to the total of mixed anions of more than 50%, and suitable for use at a high temperature, is used at room temperature, the etching rate for the steel material is very low, and especially when a continuous immersion treatment is carried out, it is difficult to form a practically useful phosphate chemical conversion coating layer.

In the process disclosed in U.S. Pat. No. 4,565,585, the steel material must be a material which can be dissolved at a high dissolving rate in combination with a treatment liquid capable of dissolving the steel material at a high dissolving rate at room temperature and the above-mentioned specific combination can be attained by using a specific treatment liquid containing a conventional principal component consisting of phosphate ions, nitrate ions, and zinc ions, and an oxidizing agent consisting essentially of at least one nitrite.

Accordingly, the process of U.S. Pat. No. 4,565,585 can be carried out by using a high temperature type phosphate chemical conversion treatment liquid composition. When the process is carried out by spraying, a practically useful phosphate chemical conversion coating layer can be formed by controlling the pH and ORP to suitable levels. However, when the treatment liquid composition of the U.S. patent is used at room temperature by immersion, even if the treatment is carried out at a pH of 3.0 or less, it is impossible to obtain a practically usable phosphate chemical conversion coating layer.

In the process of the present invention, the specific phosphate chemical conversion treatment liquid having a weight ratio (P/An) of the phosphate ions to the total of mixed anions of ½ or less enables the etching (dissolution) of the surface portion of the steel material to be evenly and quickly carried out at a large dissolving rate and at room temperature by the action of the anions different from the phosphate ions.

The specific weight ratio (P/An) at a low level causes a decrease in content of the phosphate ions, which causes an increase in the viscosity of the treatment liquid, and thus results in a decrease in the viscosity of the phosphate chemical conversion treatment liquid. This low viscosity of the treatment liquid is effective for promoting reactions occurring at an interface between the steel material and the treatment liquid. Also, the specific weight ratio (P/An) is effective for accelerating the reactions of the metal ions such as zinc ions to form metal phosphate, and for promoting the formation of the phosphate chemical conversion coating layer.

The process of the present invention is an improvement of the process of U.S. Pat. No. 4,565,585 and can enhance the above-mentioned functions of the reactions.

The present invention will be further explained by the following examples.

Examples 1 to 4 and Comparative Examples 1 to 3

In each of Examples 1 to 4 and Comparative Examples 1 to 3, a thin steel sheet for a car, having a length of 150 mm, a width of 70 mm, and a thickness of 1 mm, was subjected to a phosphate chemical conversion treatment by batch type spraying or by batch type immersion.

The spraying procedures were carried out under the following conditions.

Pressure: 0.5 to 0.7 kg/cm$^2$

The immersion procedures were carried out under the following conditions.

Capacity of tank: 100 l

Circulation rate of treatment liquid: 50 l/min

The treatment conditions are shown in Table 1, and the results of the treatment are shown in Table 1 and FIGS. 1 to 6.

In each of the examples and comparative examples, the corrosion resistance of the product was determined by a salt spray test in accordance with Japanese Industrial Standard (JIS)-Z-2371. The X-ray diffraction test was carried out by using Cu-K $\alpha$ rays.

The concentration of an accelerator was determined by analyzing the amount of $NO_2^-$ liberated by the sodium sulfamate method.

The oxidation-reduction potential (ORP) was measured by an AgCl electrode. The value of ORP measured by the AgCl electrode is converted to a value based on the hydrogen standard electrode potential by adding about 207 to the measured ORP value.

In each of the examples and comparative examples, the thin steel sheet was degreased by an alkali treatment and surface-controlled by a titanium phosphate colloid treatment, before the phosphate chemical conversion treatment.

TABLE 1

| Example No. | Composition treatment bath | pH and ORP | Temperature of treatment bath | Amount of coating layer | Painting method | Corrosion resistance | X ray diffraction | Conversion treatment |
|---|---|---|---|---|---|---|---|---|
| Comparative Example 1 | Palbond 3004*1 (Nihon Parkerizing Co., Ltd.) P/An*2 = 0.5 P/M*3 = 10.8 | — | 50° C. | 2.5 g/m$^2$ | Cationic electro-deposition coating Thickness of coating = 20 $\mu$m | Salt spray test 840 Hr Width of scratch rust = 2.5 mm | P ratio = 0.9 or more | Immersion treatment for 2 min/lot*4 |
| Example 1 | $Zn^{2+}$ = 5 g/l $PO_4^{3-}$ = 10 g/l $Ni^{2+}$ = 0.5 g/l $NO_3^-$ = 35 g/l $Cl^-$ = 5 g/l Oxidizing agent ($NO_2^-$) 7 point P/An = 0.20 P/M = 2 | pH = 2.7 ORP = 220 mV | 22° C. | 2.1 g/m$^2$ | Cationic electro-deposition coating Thickness of coating = 20 $\mu$m | Salt spray test 840 Hr Width of scratch rust = 2.5 mm | P ratio = 0.58 | Immersion treatment for 2 min/lot |
| Comparative Example 2 | $Zn^{2+}$ 5.0 g/l $PO_4^{3-}$ = 24 g/l $Ni^{2+}$ = 0.4 g/l $NO_3^-$ = 10 g/l $F^-$ = 0.2 g/l Oxidizing agent ($NO_2^-$) 0.5 point P/An = 0.70 P/M = 4.8 | pH = 3.2 ORP = 208 mV | 18° C. | Coating layer was not formed | | | — | Immersion treatment for 2 min/lot |
| Comparative Example 3 | $Zn^{2+}$ = 7.8 g/l $PO_4^{3-}$ = 31 g/l $Ni^{2+}$ = 0.3 g/l $NO_3^-$ = 3.0 g/l Oxidizing agent ($NO_2^-$) 0.8 point P/An = 0.91 P/M = 4.0 | pH = 2.8 ORP = 208 mV | 20° C. | 6.3 g/m$^2$ | Anionic electro-deposition coating Thickness of coating = 20 $\mu$m | Salt spray test 384 Hr Width of scratch rust = 3.5 mm | P ratio = 0 | Spray treatment for 2 min/lot |
| Example 2 | $Zn^{2+}$ = 5 g/l $PO_4^{3-}$ = 7.5 g/l $Ni^{2+}$ = 0.5 g/l $NO_3^-$ = 20 g/l $ClO_3^-$ = 5 g/l $F^-$ = 0.1 g/l Oxidizing agent ($NO_2^-$) 7 point P/An = 0.23 P/M = 1.5 | pH = 2.7 ORP = 220 mV | 20° C. | 1.32 g/m$^2$ | Anionic electro-deposition coating Thickness of coating = 20 $\mu$m | Salt spray test 384 Hr Width of scratch rust = 2.5 mm | P ratio = 0 | Spray treatment for 2 min/lot |
| Example 3 | $Zn^{2+}$ = 30 g/l $PO_4^{3-}$ = 10 g/l $Cl^-$ = 30 g/l $F^-$ = 0.2 g/l $H_2O_2$ = 6 g/l P/An = 0.25 P/M = 0.33 | pH = 1.5 ORP = 550 mV | 20–25° C. | 0.46 g/m$^2$ | — | — | — | Immersion treatment for 2 min/lot |
| Example 4 | $Zn^{2+}$ = 1 g/l $PO_4^{3-}$ = 3 g/l $Ni^{2+}$ = 0.5 g/l $No_3^-$ = 20 g/l Oxidizing agent ($NO_2^-$) 2 point P/An = 0.13 | pH = 3.9 ORP = 200 mV | 20–25° C. | 2.2 g/m$^2$ | — | — | — | Spray treatment for 2 min/lot |

TABLE 1-continued

| Example No. | Composition treatment bath | pH and ORP | Temperature of treatment bath | Amount of coating layer | Painting method | Corrosion resistance | X ray diffraction | Conversion treatment |
|---|---|---|---|---|---|---|---|---|
| | P/M = 3 | | | | | | | |

Note:
*1Palbond 3004, trademark of a phosphotizing agent, made by Nihon Parkerizing Co., Ltd.
*2P/An - weight ratio of phosphate ions to total of mixed anions
*3P/M - weight ratio of phosphate ions to metal ions
*4Lot consists of 8 steel sheets Referring to Table 1, the procedures of Comparative Example 1 were carried out under typical conditions of a conventional process of the phosphate chemical conversion treatment at a high temperature by immersion. In Example 1, the weight ratio P/n was at a low level of 0.20 and the weight ratio P/M was at a level of 2, which was less than 3.

In a comparison of Comparative Example 1 with Example 1, it is clear that the phosphate chemical conversion coating formed by the process of the present invention exhibits a similar corrosion resistance to that of the conventional process. Also, the coating made by the process of the present invention had a relatively high P ratio of 0.58 in the X-ray diffraction. Accordingly, it is confirmed that the process of the present invention effectively produces a strong phosphate chemical conversion coating layer.

In Comparative Example 2, the weight ratio P/An was at an excessively high level of 0.70 and the treatment was carried out at room temperature by immersion. Therefore, a phosphate chemical conversion coating layer was not formed.

In each of Comparative Example 3 and Example 2, the treatment was carried out by spraying, a phosphate chemical conversion coating layer was formed with a satisfactory efficiency, and the P ratio was zero because the steel sheet surface was etched to a smaller extent than that by immersion. In a comparison of Comparative Example 3 with Example 2, it was found that, in Comparative Example 3 in which the weight ratio P/An was at a high level of 0.91, it was necessary to use the metal ions in a large concentration at a low level of pH of less than 3.2, and thus the resultant coating layer was in a large amount of 6.3 g/m$^2$. As a result, the corrosion resistance of the resultant painted steel sheet in Comparative Example 3 was poorer than that of Example 2. This clearly shows that, when the treatment is carried out at room temperature by spraying, it is necessary to vary the composition of the treatment liquid in response to the range of pH used.

Examples 3 and 4 illustrate that, even when the treatment liquid had a low pH of 1.5 in Example 3 or a high pH of 3.9 in Example 4, a phosphate chemical conversion coating layer could be formed.

The phosphate chemical conversion coating layer formed in some of the examples and comparative examples indicated X-ray diffraction patterns, and scanning electron microscopic views as shown in the drawings, as shown below.

Figure 2:
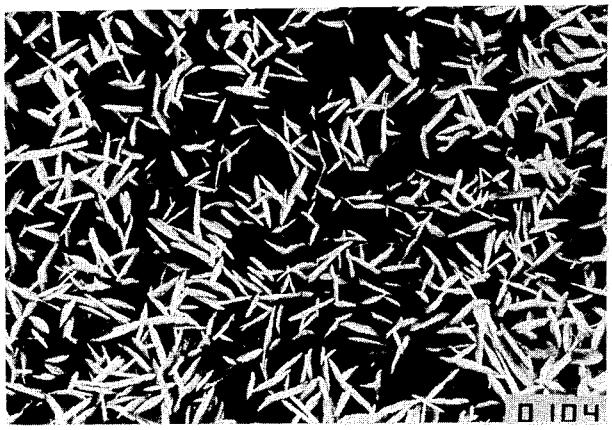
FIG. 2 is a scanning electron microscopic photograph indicating a grain structure of the phosphate chemical conversion coating layer (Example 1) shown in FIG. 1.
Figure 4:
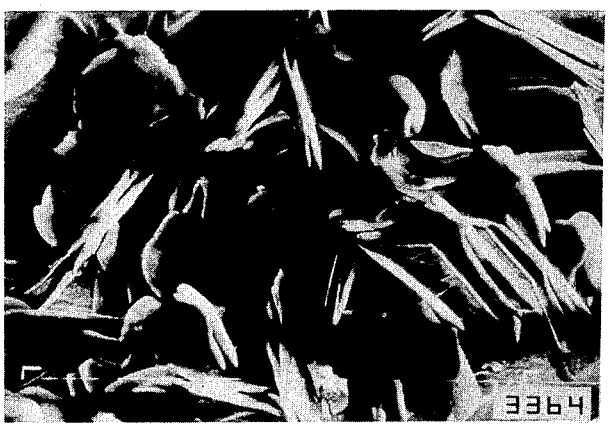
FIG. 4 is a scanning electron microscopic photograph indicating a grain structure of the phosphate chemical coating layer (Comparative Example 4) shown in FIG. 3; and, FIG. 5 shows an X-ray diffractiometric pattern of another embodiment of (Example 2) of the phosphate chemical conversion coating layer formed on a steel sheet in accordance with the process of the present invention.
Figure 3:
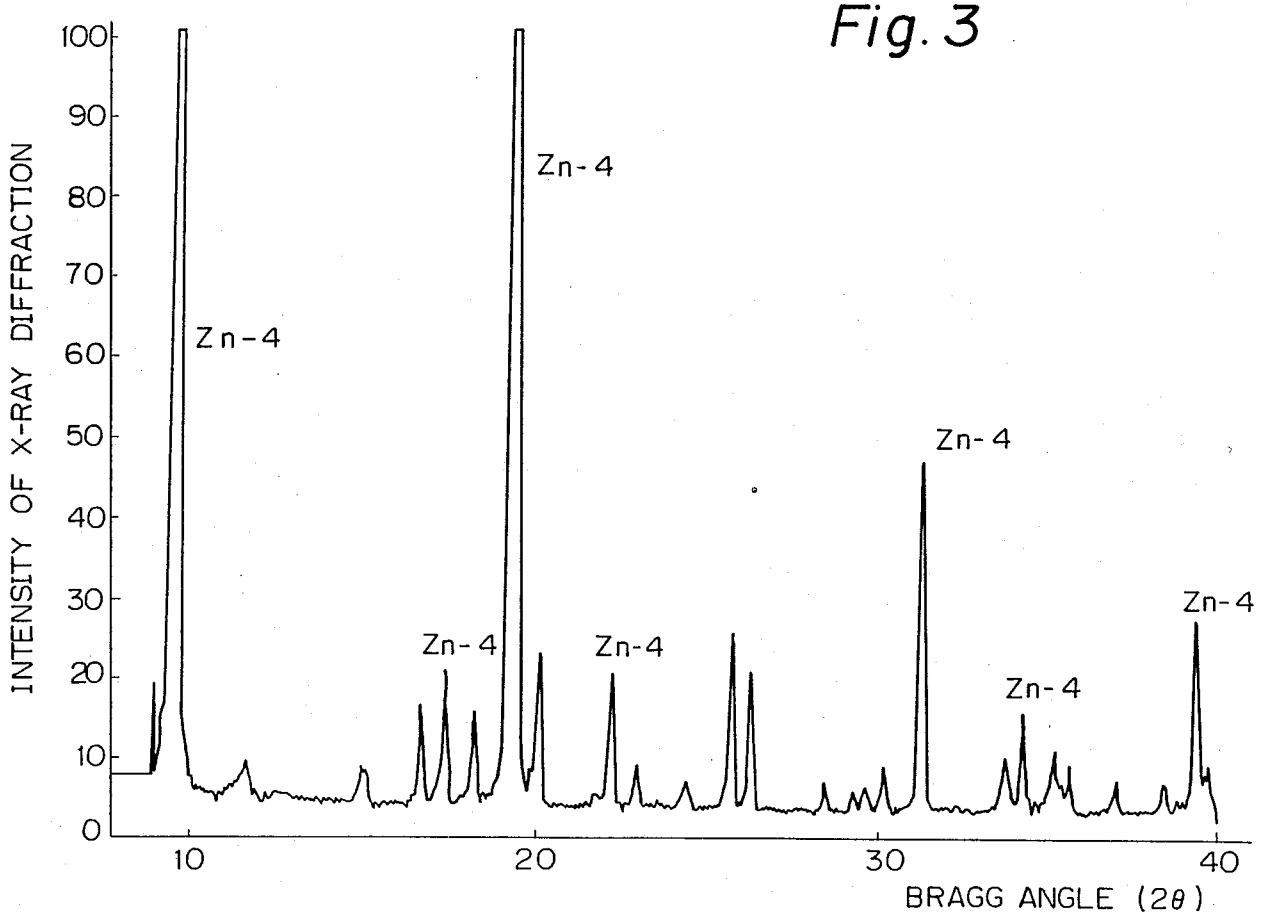
FIG. 3 shows an X-ray diffractiometric pattern of an embodiment (Comparative Example 3) of the phosphate chemical conversion coating layer formed on a steel sheet in accordance with a conventional process.

| Example No. | X-ray diffractiometric chart | Scanning electron microscopic photograph |
|---|---|---|
| Example 1 | FIG. 1 | FIG. 2 |
| Comparative Example 3 | FIG. 3 | FIG. 4 |

-continued

Figure 5:
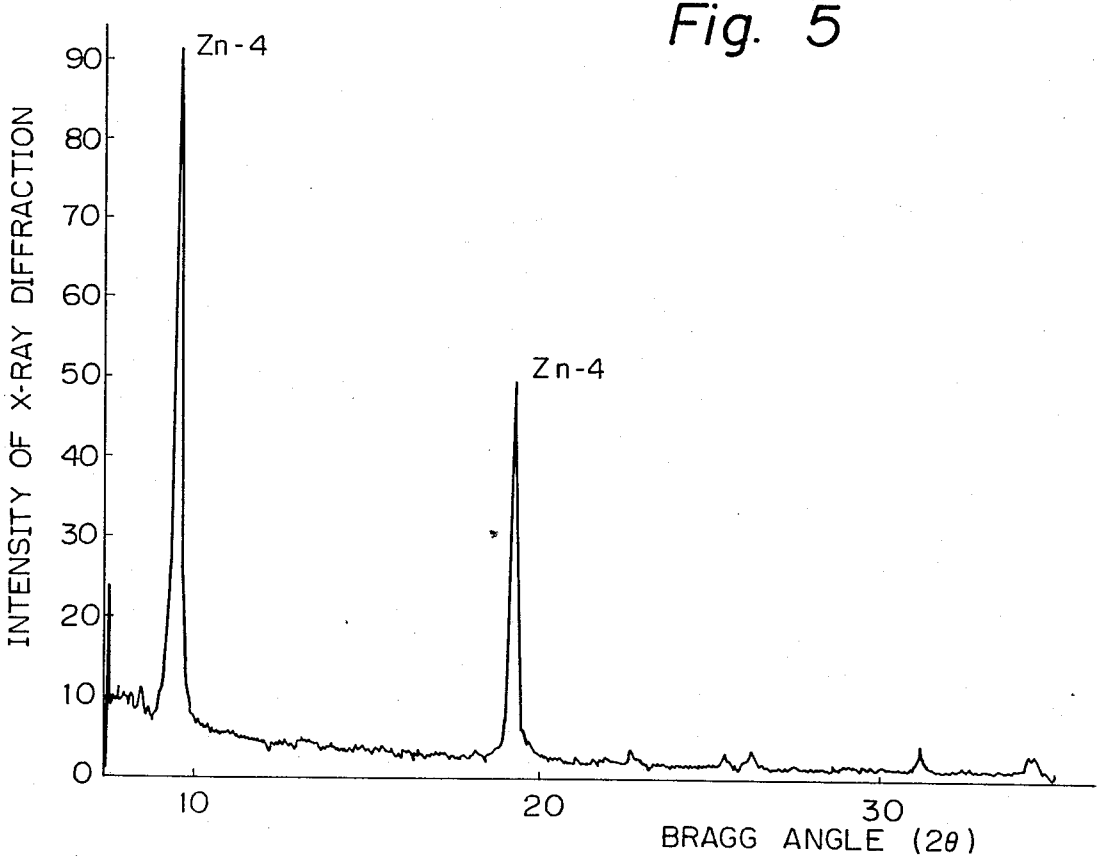

| Example No. | X-ray diffractiometric chart | Scanning electron microscopic photograph |
|---|---|---|
| Example 2 | FIG. 5 | |

In FIGS. 1, 3 and 5, Zn-4 represents $Zn_3(PO_4)_2.4H_2O$ (Hopeite), and n-Fe-4 represents $Zn_2Fe(PO_4)_2 \cdot 4H_o$ (Posphophillite).

The values of the P ratio indicated in Table 1 were calculated in accordance with th equation:

$$P \text{ ratio} = \frac{P(\text{Zn—Fe—4})}{P(\text{Zn—Fe—4}) + P(\text{Zn—4})}$$

wherein P(Zn-Fe-4) represents an intensity of X-ray diffraction corresponding to Zn-Fe-4 and P(Zn-4) represents an intensity of X-ray diffraction corresponding to Zn-4.

Referring to Table 1, the value of the P ratio in Example 1 is smaller than that in Comparative Example 1. This difference is assumed to be derived from the difference in the intensity of etching of the steel sheet surface between Example 1 and Comparative Example 1. However, the corrosion resistance of the painted steel sheet Example 1 was the same as that in the Comparative Example 1. Also, FIG. 2 clearly shows that the grain structure of the phosphate chemical conversion coating layer of Example 1 prepared in accordance with the process of the present invention was uniform and dense, and this structure greatly contributed to the enhancement of the corrosion resistance.

In Comparative Example 3 and Example 2, the values of the P ratio were zero. As a reason for this, it is assumed that, in the low temperature treatment by spraying, the etching reaction for iron was completed at a high reaction rate so that the degree of contribution of the dissolved iron ions to the formation of the chemical conversion coating layer is small compared with that in the immersion method, and thus the resultant chemical conversion coating layer cannot contain phosphophyllite.

In the treatment liquid of Comparative Example 3, the low pH of 2.8 caused zinc ions to be in a large content of 7.8 g/l, to make the formation of the coating layer possible, and the large amounts of phosphate ions and zinc ions resulted in a large amount of the coating layer of 6.3 g/m$^2$, which amount was in excess of an adequate content of a coating layer to be located under a paint layer.

The difference in grain structure between the scanning electron microscopic views in FIG. 2 (Example 1) and FIG. 4 (Comparative Example 3) is assumed to be derived from the difference in amount between the coating layers produced in Example 1 and Comparative Example 3.

Examples 5 to 7 and Referential Example 1

In each of Example 5 to 7 and Referential Example 1, a phosphate chemical conversion treatment was carried out by a continuous immersion, using a treatment liquid having the composition indicated in Table 2 under the following conditions.

Capacity of immersion vessel: 100 l

Circulation rate of treatment liquid: 50 l/min

The continuous immersion treatment was carried out for at least 7 hours, except for an interruption time of the treatment.

Also, the treatment liquid was controlled by an automatic control method in the following manner.

pH: when the pH of the treatment liquid became as high as a predetermined highest level or higher, a principal feed including phosphate ions ($PO_4^{3-}$), , nitrate ions ($NO_3^-$), and zinc ions ($Zn^{2+}$) was added to the treatment liquid, and when the pH of the treatment liquid became as low as a predetermined lowest level or lower, an aqueous solution containing NaOH was added to the treatment liquid, in accordance with the process disclosed in U.S. Pat. No. 4,565,585.

ORP: when the ORP of the treatment liquid became as high as a predetermined highest level or higher, an aqueous solution containing $Fe^{2+}$ ($FeSO_4$) was added to the treatment liquid, and when the ORP became as low as a predetermined lowest level or lower, an aqueous solution containing $NaNO_2$ was added to the treatment liquid.

EC: when an electroconductivity (EC) of the treatment liquid was measured, if the measured value of the EC was lower than a predetermined lowest value, the above-mentioned principal feed was added to the treatment liquid, and if the measured EC value was higher than a predetermined highest value, the principal feed was not added to the treatment liquid, even if the value of the pH was higher than the predetermined highest value.

The salt spray test was applied to the resultant painted steel sheet in the same manner as described in Example 1. The results are indicated in Table 2.

The phosphate chemical conversion treated steel sheets in Example 5 to 7 exhibited excellent resistance to corrosion (seen from the results of the salt spray test and the width of the scratch-rust).

The treating liquid of Examples 6 and 7 having a low zinc concentration (2 g/l) and an ORP of 480 mV (AgCl electrode), exhibited a very high chemical activity. Accordingly, $Fe^{2+}$ ions in the treatment liquid were easily oxidized to $Fe^{3+}$ ions by oxygen dissolved from the ambient air into the treatment liquid, and thus it was confirmed that a sludge consisting of $Fe_2O_3$, etc., was formed in the treatment liquid.

Accordingly, in Examples 6 to 7, the treatment liquid was stirred in a manner such that oxygen in the combined air was not introduced into the treatment liquid.

Referential Example 1 illustrated that, where the phosphate chemical conversion treatment at room temperature is carried out by a continuous immersion method, preferably the weight ratio P/An is less than 0.4.

TABLE 2

| Example No. | Composition treatment bath | pH and ORP | Temperature of treatment bath | Amount of coating layer | Painting method | Corrosion resistance | X ray diffraction | Treatment | Evaluation of method for automatically controlling concentration of phosphate chemical conversion treatment bath |
|---|---|---|---|---|---|---|---|---|---|
| Example 5 | $Zn^{2+}$ = 3 g/l<br>$PO_4^{3-}$ = 8 g/l<br>$NO_3^-$ = 20 g/l<br>$Ni^{2+}$ = 0.5 g/l<br>$F^-$ = 0.1 g/l<br>Oxidizing agent ($NO_2^-$) = 2.5–3.5 point<br>P/An = 0.29<br>P/M = 2.7 | pH = 3.2–3.3<br>ORP = 430–440 mV | 25–30° C. | 3.31 g/m$^2$ | Cationic electro-deposition coating<br>Thickness of coating = 20 μm | Salt spray test = 1000 Hr<br>Width of scratch-rust = 2 mm | P ratio = 0.38 | Continuous immersion treatment for 2 min/lot | Good |
| Example 6 | $Zn^{2+}$ = 2 g/l<br>$PO_4^{3-}$ = 5 g/l<br>$NO_3^-$ = 20 g/l<br>$Ni^{2+}$ = 0.5 g/l<br>$F^-$ = 0.1 g/l<br>Oxidizing agent ($NO_2^-$) = 4.8–7 point<br>P/An = 0.20<br>P/M = 2.5 | pH = 3.3–3.4<br>ORP = 490–550 mV | 24–29° C. | 1.69 g/m$^2$ | Cationic electro-deposition coating<br>Thickness of coating = 20 μm | Salt spray test = 1000 Hr<br>Width of scratch-rust = 1 mm | P ratio ≧ 0.9 | Continuous immersion treatment for 2 min/lot | Good |
| Example 7 | $Zn^{2+}$ = 2 g/l<br>$PO_4^{3-}$ = 5 g/l<br>$NO_3^-$ = 20 g/l<br>$Ni^{2+}$ = 0.5 g/l<br>$F^-$ = 0.1 g/l<br>Oxidizing agent ($NO_2^-$) = 5–9 point<br>P/An = 0.20<br>P/M = 2.5 | pH = 3.38–3.42<br>ORP = 530–550 mV | 27–30° C. | 1.87 g/m$^2$ | Cationic electro-deposition coating<br>Thickness of coating = 20 μm | Salt spray test = 1000 Hr<br>Width of scratch-rust = 1 mm | P ratio ≧ 0.9 | Continuous immersion treatment for 2 min/lot | Good |
| Referential Example 1 | $Zn^{2+}$ = 3 g/l<br>$PO_4^{3-}$ = 15 g/l<br>$NO_3^-$ = 20 g/l<br>$Ni^{2+}$ = 0.5 g/l<br>Oxidizing agent ($NO_2^-$) = 2.5–3.5 point<br>P/An = 0.43<br>P/M = 5 | pH = 3.2–3.3<br>ORP = non-controllable | 25° C. | — | — | — | — | Continuous immersion treatment for 2 min/lot | Bad |

The above description, especially the examples, clearly illustrates that the process of the present invention made possible the formation of a phosphate chemical conversion coating layer having an excellent quality even at room temperature and by immersion.

In the conventional phosphate chemical conversion treatment at room temperature by immersion, where the pH of the treatment liquid is 3.2 or less, the formation of the phosphate coating layer is unsatisfactory but the etching effect of the treating liquid is satisfactory. However, where the pH is at a high level, there is a disadvantage in that the etching effect on the steel material is unsatisfactory, and thus a coating layer having a satisfactory mechanical strength and bonding property to the steel material is not formed.

Compared with the conventional process, a satisfactory phosphate chemical conversion coating layer can be formed, in accordance with the process of the present invention, at room temperature by immersion at a wide range of pH.

Accordingly, in accordance with the process of the present invention, the room temperature immersion method usually utilized in various chemical conversion treatments for steel sheets for cars and for a pretreatment of a cold forging operation can be industrially practiced at room temperature. Therefore, the present invention is useful in industry.

Also, in accordance with the process of the present invention, a phosphate chemical conversion coating layer having excellent corrosion resistance can be formed using a room temperature spraying method, as illustrated in Example 2 in comparison with Comparative Example 3.

Furthermore, it was confirmed that, in accordance with the process of the present invention, it became possible to form a satisfactory coating layer even at a low pH range of 1.0 or less, in which range it was difficult to produce the coating layer by the conventional processes.

We claim:

1. A process of phosphate conversion treatment for a steel material comprising bringing a steel material into contact with a phosphate chemical conversion treatment liquid containing mixed anions consisting of phosphate ions and at least one other type of active anions, at least one type of metal ions capable of forming a chemical conversion coating layer, and an oxidizing agent, to provide a phosphate chemical conversion coating layer on the surfaces of the steel material, wherein the temperature of the phosphate chemical conversion treatment liquid is controlled to a level of 40° C. or less without external heating of the liquid, and the composition of the phosphate chemical conversion treatment liquid is controlled in a manner such that the ratio )P/An) of a weight (P) of the phosphate ions to a total weight (An) of the mixed anions therein is ½ or less, the pH thereof is in the range of from 0.5 to 4.5 and the oxidation-reduction potential (hydrogen standard electrode potential) of at least 300 mV wherein, the process as claimed in claim 12, wherein, in the control of the ratio P/An, the pH and the oxidation-reduction potential of the phosphate chemical conversion treatment liquid respectively to a predetermined level.

(A) when the pH of the treatment liquid becomes higher than a predetermined maximum level, a principal feed including the chemical conversion coating layer-forming metal ions and the active anions is added to the treatment liquid, and when the pH of the treatment liquid becomes lower than a predetermined minimum level, an aqueous alkali solution is added to the treatment liquid;

(B) when the ORP of the treatment liquid becomes higher than a predetermined maximum level, an aqueous solution containing $Fe^{2+}$ ions is added to the treatment liquid, and when the ORP of the treatment liquid becomes lower than a predetermined minimum level, an aqueous solution containing an oxidizing agent is added to the treatment liquid, and (C) when the electroconductivity (EC) of the treatment liquid becomes lower than a predetermined minimum value, the above-mentioned principal feed is added to the treatment liquid, and when the EC of the treatment liquid becomes higher than a predetermined maximum level, the principal feed is not added to the treatment liquid even if the value of the pH is higher than the predetermined maximum level.

2. The process as claimed in claim 1, wherein said at least one other type of active anions comprises at least one non-metallic atom.

3. The process as claimed in claim 1, wherein said at least one other type of active anions comprises at least one member selected from the group consisting of oxacid ions and halogen ions.

4. The process as claimed in claim 3, wherein the oxacid ions are selected from the group consisting of nitrate ions and mixtures of nitrate ions and chlorate ions.

5. The process as claimed in claim 1, wherein the chemical conversion treatment is carried out by an immersion method.

6. The process as claimed in claim 1, wherein the oxidizing agent comprises at least one member selected from the group consisting of hydrogen peroxide, hydrogen peroxide-generating substances, and nitrite ions.

7. The process as claimed in claim 1, wherein the chemical conversion coating layer-forming metal ions are selected from the group consisting of zinc ions, manganese ions, calcium ions, magnesium ions and iron ions.

8. The process as claimed in claim 1, wherein the chemical conversion coating layer-forming metal ions are in an amount of 0.5 g/l or more in the treatment liquid.

9. The process as claimed in claim 1, wherein the ratio (P/M) of the weight (P) of the phosphate ions to the weight (M) of the chemical conversion coating layer-forming metal ions is in a range of from 0.3 to 3.

10. The process as claimed in claim 1, wherein the chemical conversion treatment is a batch type treatment.

11. The process as claimed in claim 1, wherein the weight ratio (P/An) of the phosphate ions (P) to the total of mixed anions (An) is in a range of from 0.08 to 0.4.

12. The process as claimed in claim 1, wherein the chemical conversion treatment is a continuous immersion treatment.

13. The process as claimed in claim 12, wherein the continuous immersion treatment is carried out by using a treatment liquid containing 1.5 to 3.0 g/l of the chemical conversion coating layer-forming metal ions, 4.5 to 9 g/l of the phosphate ions and 10 to 70 g/l, in terms of $NO_3^-$ ions, of the other type of active anions.

* * * * *

UNITED STATES PATENT AND TRADEMARK OFFICE

CERTIFICATE OF CORRECTION

PATENT NO. : 4,880,476

DATED : November 14, 1989

INVENTOR(S) : MATSUDA et al

It is certified that error appears in the above-identified patent and that said Letters Patent is hereby corrected as shown below:

ON TITLE PAGE:--[73] Assignees, should read as following:

NIPPONDENSO CO., LTD.

Kariya-shi, Aichi, Japan
and

NIHON PARKERIZING CO., LTD.

Tokyo, Japan--

Signed and Sealed this

Twenty-seventh Day of August, 1991

*Attest:*

HARRY F. MANBECK, JR.

*Attesting Officer*

*Commissioner of Patents and Trademarks*